US007927137B2

(12) United States Patent
Nakayama et al.

(10) Patent No.: US 7,927,137 B2
(45) Date of Patent: Apr. 19, 2011

(54) COAXIAL CABLE CONNECTOR

(75) Inventors: Kazuyoshi Nakayama, Nisshin (JP); Kazutoshi Itakura, Nisshin (JP); Tsuneyuki Inayoshi, Nisshin (JP)

(73) Assignee: Masprodenkoh Kabushikikaisha (JP)

( * ) Notice: Subject to any disclaimer, the term of this patent is extended or adjusted under 35 U.S.C. 154(b) by 50 days.

(21) Appl. No.: 12/593,027

(22) PCT Filed: Jan. 11, 2008

(86) PCT No.: PCT/JP2008/050285

§ 371 (c)(1), (2), (4) Date: Sep. 25, 2009

(87) PCT Pub. No.: WO2008/117547

PCT Pub. Date: Oct. 2, 2008

(65) Prior Publication Data

US 2010/0120289 A1 May 13, 2010

(30) Foreign Application Priority Data

Mar. 26, 2007 (JP) ..... 2007-079841

(51) Int. Cl.
*H01R 9/05* (2006.01)

(52) U.S. Cl. ..... 439/585

(58) Field of Classification Search ..... 439/585, 439/583, 578
See application file for complete search history.

(56) References Cited

FOREIGN PATENT DOCUMENTS

| | | | |
|---|---|---|---|
| JP | H03-5109 | Y2 | 2/1991 |
| JP | H11-167963 | A2 | 6/1999 |
| JP | 2005-108566 | A | 4/2005 |
| JP | 2006-351328 | A | 12/2006 |
| JP | 2007-73367 | A | 3/2007 |

*Primary Examiner* — Alexander Gilman
(74) *Attorney, Agent, or Firm* — Gray Robinson, P.A.

(57) ABSTRACT

The coaxial cable connector includes a connector body, a securing ring, and a holder. The connector body includes an insertion section, a flange section, and a fitting section. The insertion section is insertable to between an insulation member and a braided conductor of the coaxial cable. The flange section is provided around the insertion section. The fitting section is rotatably provided at the insertion section on an opposite side of the coaxial cable. The securing ring is used to crimp and fix the coaxial cable to the connector body. The holder positions the securing ring around the insertion section of the connector body.

9 Claims, 7 Drawing Sheets

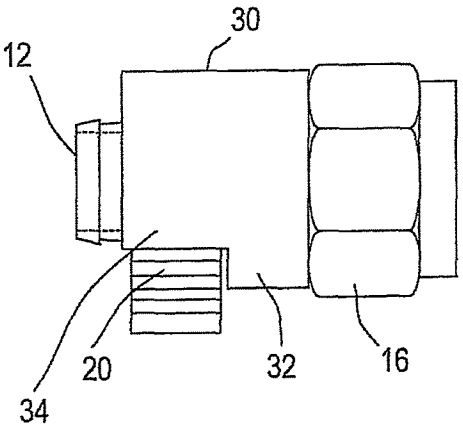
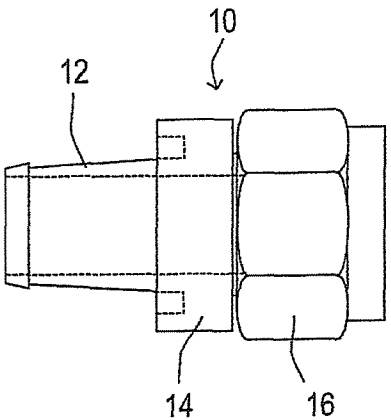
FIG. 1A
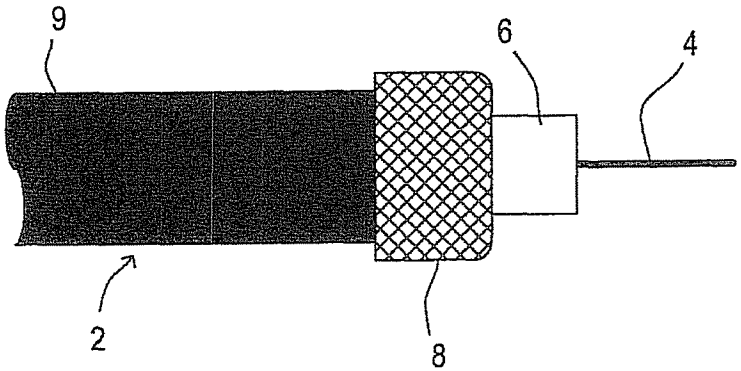
FIG. 1B
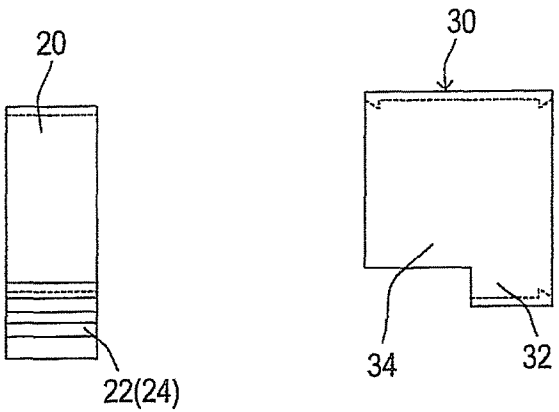

COAXIAL CABLE CONNECTOR

CROSS REFERENCED TO RELATED APPLICATIONS

This is a U.S. National Phase Entry under 35 U.S.C. §371 of, and claims priority under 35 U.S.C. Sections 119(a)-(d), 120, 363 and 365 to, International Application No. PCT/JP2008/050285, filed Jan. 11, 2008 which designated the United States and at least one other country in addition to the United States and claimed priority to Japanese Application No. 2007-079841, filed Mar. 26, 2007. The specifications of these applications are hereby expressly incorporated by reference in their entirety to form a part of this application.

TECHNICAL FIELD

The present invention relates to a coaxial cable connector to be attached to an end section of a coaxial cable and connect the coaxial cable with an object to be connected such as an F-type relay, an F-type antenna terminal and so on.

BACKGROUND ART

Conventionally, this type of coaxial cable connector is known to have a connector body 10 and a securing ring 20 as shown in FIG. 7A. The connector body 10 has a tubular insertion section 12, a flange section 14, a fitting section 16, and so on. The insertion section 12 is insertable to between an insulation member 6, which is around a core wire 4 of a coaxial cable 2, and a braided conductor 8 around the insulation member 6. The flange section 14 is provided around the insertion section 12 to position the coaxial cable 2. The fitting section 16 is rotatably provided at the insertion section 12 on an opposite side of the coaxial cable 2, and into which an object to be connected, such as an F-type relay, an F-type antenna terminal and so on, can be screwed. The securing ring 20 is used to crimp (pressure-bond) and fix the coaxial cable 2 to the insertion section 12 of the connector body 10 from an outer periphery of the coaxial cable 2, after the insertion section 12 of the connector body 10 is inserted inside an inner periphery of the braided conductor 8 of the coaxial cable 2 (see Patent Literatures 1, 2 and so on, for example).

When attaching this type of coaxial cable connector to the coaxial cable 2, a tip end of the coaxial cable 2 is processed as follows. Firstly, a cover member 9 around the braided conductor 8 is removed by a predetermined length of La from the tip end of the coaxial cable 2. The braided conductor 8 is then folded back rearward along an edge of the cover member 9. Thereafter, the insulation member 6 inside the braided conductor 8 is cut off to protrude on the tip end side by a predetermined length of Lb. As a result, the core wire 4 is exposed by a predetermined length of Lc.

After the processing of the coaxial cable 2, the coaxial cable connector is fixed to the coaxial cable 2. That is, as shown in FIGS. 7A and 7B, after the securing ring 20 is fitted to the coaxial cable 2, the connector body 10 is inserted from the tip end side of the coaxial cable 2 such that the insulation member 6 is inserted into the insertion section 12. Thereafter, as shown in FIG. 7C, the securing ring 20 is moved toward the tip end side of the coaxial cable 2 to be arranged around the insertion section 12. A pair of crimping projections (pressure-bonding projections) 22, 24 provided in a protruding manner on the securing ring 20 is then crimped with a pair of pliers or the like (see FIGS. 7D and 7E).

Patent Literature 1: Unexamined Japanese Patent Publication No. H11-167963

Patent Literature 2: Unexamined Japanese Patent Publication No. 2005-108566

DISCLOSURE OF THE INVENTION

Problems to be Solved by the Invention

The reason why the braided conductor 8 is folded back from the edge side of the cover member 9 as above when attaching the coaxial cable connector to the coaxial cable 2 is to facilitate insertion of the insertion section 12 of the connector body 10 to between the insulation member 6 and the braided conductor 8 of the coaxial cable 2, and to ensure connection of the braided conductor 8 to the insertion section 12 (and to the connector body 10). However, when the braided conductor 8 is folded back as above, the braided conductor 8 has to be received inside the securing ring 20 as shown in FIG. 7C, when crimping and fixing the coaxial cable 2 with the securing ring 20. Therefore, there is a problem that the crimping operation is bothersome.

That is, the braided conductor 8 comes loose at the time of the fold-back operation. The tip end of the braided conductor 8 spreads out around the coaxial cable 2. Thus, it is difficult to put the braided conductor 8 inside the securing ring 20 at the time of the crimping operation. The crimping operation becomes tiresome.

The reason why the braided conductor 8 has to be received inside the securing ring 20 at the time of the crimping operation is that, if the braided conductor 8 is not received inside the securing ring 20, not only the appearance is unattractive but also defects may be caused as a result of a contact between the braided conductor 8 and other wiring or electric component.

Although cutting-off of a protruding stray part of the braided conductor 8 may be possible, the cutting operation is troublesome. That is, in order to inhibit the above problem (contact of the braided conductor 8 with other wiring and electric component), it is necessary to cut the protruding stray part at the base thereof. Attentiveness is required of the operator. Therefore, the cutting operation takes a long time.

The present invention has been made in view of the above problems. A coaxial cable connector is designed so that a coaxial cable is crimped and fixed to a connector body with a securing ring after the connector body is attached to a tip end of the coaxial cable. An object of the present invention is to make it easier to attach the coaxial cable connector to the coaxial cable.

Means to Solve the Problems

The invention of a first aspect which was made in order to achieve the above object provides a coaxial cable connector having a connector body and a securing ring. The connector body includes a tubular insertion section, a flange section, and an annular fitting section. The insertion section is insertable to between an insulation member around a core wire of a coaxial cable and a braided conductor around the insulation member. The flange section is provided around the insertion section, and both the braided conductor of the coaxial cable and a cover member around the braided conductor abut against the flange section to position the insertion section with respect to the coaxial cable when the insertion section is inserted in the coaxial cable. The fitting section is provided at the insertion section on an opposite side of the coaxial cable, and an object to be connected can be fittingly inserted into the fitting section. The securing ring includes a pair of crimping projections provided on an outer periphery thereof. The securing ring is used to crimp and fix the coaxial cable to the insertion section from a periphery of the coaxial cable after the insertion section of the connector body is inserted in the coaxial cable. The coaxial cable connector is provided with a holder that includes a tubular fixation section and a holding section. The fixation section is fixable around the flange section. The holding section is provided in an extending manner from the fixation section to hold the securing ring from a periphery thereof while the crimping projections are protruded outward. The holder positions the securing ring at a position where the coaxial cable is crimped.

According to the invention of a second aspect, the holder is configured separately from the connector body, and the holder includes a fixing projection formed at ah open end of the fixation section on an opposite side of the holding section, in the coaxial cable connector of the first aspect. The fixing projection inhibits the holder from falling off of the flange section by engaging with a corner edge portion of the flange section on a side of the fitting section when the flange section is inserted in the fixation section.

According to the invention of a third aspect, the holder includes a wall section that has an opening, through which the insertion section is insertable, the wall section being formed at the open end of the fixation section on the opposite side of the holding section, in the coaxial cable connector of the first aspect. The holder is integrated with the connector body by positioning the wall section between the flange section and the fitting section around the insertion section.

According to the invention of a fourth aspect, the holding section is configured by a tubular member on which a notch is formed, and the pair of crimping projections are protruded outward from the notch so that the pair of the crimping projections can be crimped outside the holder, in the coaxial cable connector of one of the first through the third aspects.

According to the invention of a fifth aspect, the holding section includes a plurality of slits formed parallel to a central axis of the holding section, in the coaxial cable connector of the fourth aspect.

According to the invention of a sixth aspect, the holding section is configured by three or more rod-shaped members which are dispersedly arranged around the securing ring, in the coaxial cable connector of one of the first through the third aspects.

According to the invention of a seventh aspect, a holding projection is formed at an open end of the holding section on an opposite side of the fixation section to inhibit the securing ring from falling off by engaging with an end portion of the securing ring held inside the holding section, in the coaxial cable connector of one of the first through the sixth aspects.

According to the invention of an eighth aspect, the fixation section includes a slit formed continuously from the open end on the side of the holding section through an opposite open end, so that the fixation section can be radially deformed when attached to the flange section, in the coaxial cable connector of one of the first through the seventh aspects.

According to the invention of a ninth aspect, the holder is formed of synthetic resin, in the coaxial cable connector of one of the first through the eighth aspects.

Effect of the Invention

The coaxial cable connector of the first aspect is provided with the holder which includes the tubular fixation section that is fixable around the flange section, and the holding section that is provided in the extending manner from the fixation section to hold the securing ring from the periphery thereof. The holder positions the securing ring at the position where the coaxial cable is crimped.

Accordingly, when attaching the coaxial cable connector of the first aspect to the tip end of the coaxial cable, after the tip end of the coaxial cable is processed in a conventional manner, the securing ring is positioned via the holder at the position where the coaxial cable is to be crimped. Then, the connector body is inserted from the tip end side of the coaxial cable such that the insulation member of the coaxial cable is inserted into the insertion section of the connector body. In this manner, the braided conductor that has been folded back rearward from the tip end side of the coaxial cable is automatically received into the securing ring.

Thus, according to the coaxial cable connector of the first aspect, it is not necessary to move the securing ring to receive the braided conductor inside the securing ring as in a case of a conventional connector, when the coaxial cable is crimped and fixed to the insertion section of the connector body using the securing ring. After attaching the connector body to the tip end of the coaxial cable, the securing ring fixed to the connector body can be simply crimped with a pair of pliers or the like. The coaxial cable connector can be smartly fixed to the tip end of the coaxial cable in this manner. Thus, according to the present invention, the crimping operation can be extremely easily carried out.

The coaxial cable connector of the first aspect can be achieved extremely easily because a conventional coaxial cable connector as shown in FIGS. 7A-7E can be utilized as it is only by being provided with the holder for holding the securing ring.

In the coaxial cable connector of the second aspect, the holder is configured separately from the connector body. And the holder includes the fixing projection formed at the open end of the fixation section on the opposite side of the holding section for fixing the holder to the flange section. Thus, according to the coaxial cable connector of the second aspect, the holder can be retrofitted onto the connector body.

On the other hand, in the coaxial cable connector of the third aspect, the holder includes the wall section formed at the fixation section thereof, which enables the holder to be integrated with the connector body by positioning the wall section of the holder between the flange section and the fitting section when the fitting section and the flange section is attached to the insertion section to assemble the connector body. Thus, according to the coaxial cable connector of the third aspect, the securing ring can be firmly positioned at the crimping position via the holder integrated with the connector body.

Here, the holding section of the holder may hold the securing ring from the periphery of the securing ring while the pair of crimping projections is protruded outward from the holding section, so that the securing ring can be crimped outside the holder with a tool.

Thus, the holding section may be formed by the tubular member on which the notch is formed. The pair of crimping projections can be protruded outward from the notch as in the coaxial cable connector of the fourth aspect. Alternatively, the holding section may be configured by the three or more rod-shaped members which are dispersedly arranged around the securing ring as in the coaxial cable connector of the sixth aspect.

When the holding section is configured by the tubular member on which the notch is formed, it is more preferable to form the plurality of slits parallel to the central axis of the holding section. When the holding section is configured by the tubular member, it may be difficult to put the securing ring in the holding section while the holder is fixed to the flange section via the fixation section. If the slits are formed on the holding section, the securing ring can be received by expanding the holding section. Therefore, the securing ring can be held attachably/detachably in the holding section of the holder while the holder is fixed to the flange section.

In the holder, it is preferable to form the holding projection at the open end of the holding section on the opposite side of the fixation section. The holding projection inhibits the securing ring from falling off by engaging with the end portion of the securing ring held inside the holding section as in the coaxial cable connector of the seventh aspect.

In the holder, further, the fixation section may include a slit formed continuously from the open end on the side of the holding section through the opposite open end as in the coaxial cable connector of the eighth aspect. Thus, the fixation section can be radially expanded when the holder is attached to the flange section. Such a configuration facilitates attachment of the holder to the flange section.

The connector body and the securing ring are conventionally formed of conductive metal because mechanical strength and electrical conductivity are required for the connector body, and mechanical strength is required for the securing ring as well. On the other hand, the holder may be formed of synthetic resin as in the coaxial cable connector of the ninth aspect because a major function of the holder is to position the securing ring. By forming the holder of synthetic resin, elasticity thereof makes it easier to attach the holder to the flange section and to put the securing ring in the holder.

BRIEF DESCRIPTION OF THE DRAWINGS

FIGS. 1A-1B are explanatory views showing a composition of a coaxial cable connector according to a first embodiment.

EXPLANATION OF REFERENCE NUMERALS

2 . . . coaxial cable, 4 . . . core wire, 6 . . . insulation member, 8 . . . braided conductor, 9 . . . cover member, 10 . . . connector body, 12 . . . insertion section, 14 . . . flange section, 16 . . . fitting section, 20 . . . securing ring, 22, 24 . . . crimping projection, 30 . . . holder, 32 . . . fixation section, 33 . . . fixing projection, 34 . . . holding section, 35 . . . holding projection, 36, 38 . . . slit.

BEST MODE FOR CARRYING OUT THE INVENTION

Embodiments of the present invention will be explained hereinafter.

First Embodiment

Figure 2A:
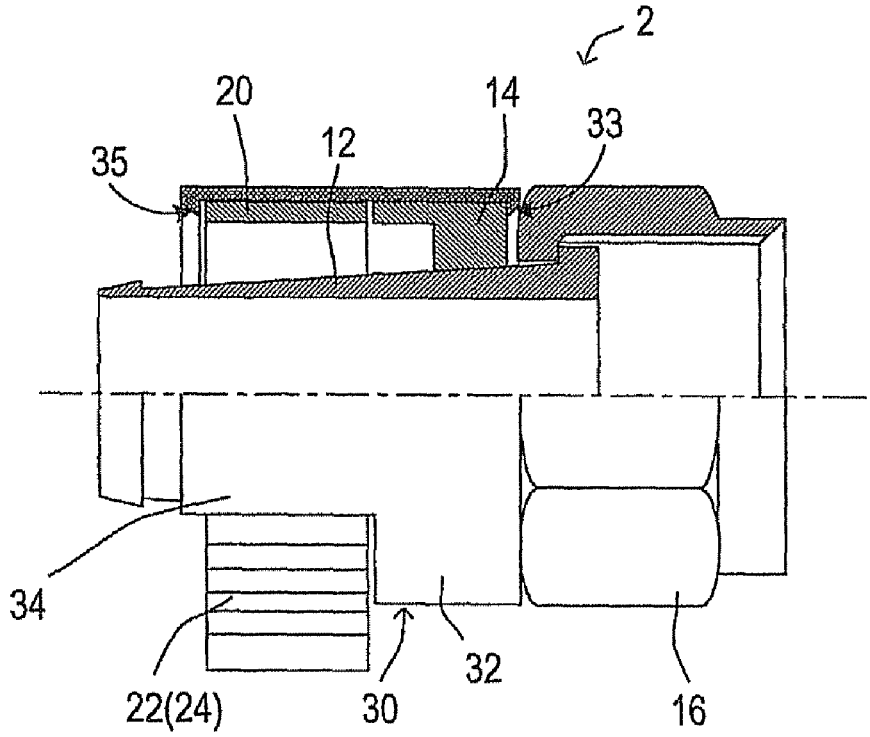
FIGS. 2A-2B are a partially fractured side view and a left-side end view showing the composition of the coaxial cable connector according to the first embodiment.
Figure 2B:
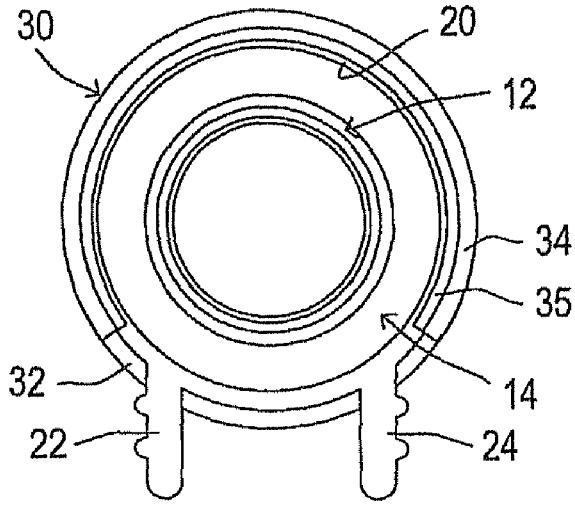

FIGS. 1A-1B and 2A-2B are explanatory views showing a composition of a coaxial cable connector (hereinafter also referred to simply as a connector) of a first embodiment according to the present invention. FIG. 1A is a side view showing the connector along with a coaxial cable 2 yet to be attached. FIG. 1B is a side view showing a disassembled state of the connector. FIG. 2A is a partially fractured side view showing an internal composition of the connector of the present embodiment. FIG. 2B is an end view of the connector viewed from a side to be attached to the coaxial cable 2 (a left side view of the connector in FIG. 2A).

The connector of the present embodiment is used to connect the coaxial cable 2 with an object to be connected such as an F-type relay, an F-type antenna terminal and so on in the same manner as in a conventional connector shown in FIGS. 7A-7E. As shown in FIGS. 1A-1B and 2A-2B, the connector of the present embodiment includes a connector body 10, a securing ring 20, and a holder 30 for positioning the securing ring 20 at a position where the coaxial cable 2 is crimped.

In the same manner as in the connector shown in FIGS. 7A-7E, the connector body 10 includes a tubular insertion section 12, a flange section 14, and a fitting section 16. The insertion section 12 is insertable to between an insulation member 6, which is around a core wire 4 of the coaxial cable 2, and a braided conductor 8. The flange section 14 is provided around the insertion section 12 to position the coaxial cable 2. The fitting section 16 in a shape of a hexagonal nut is rotatably provided at the insertion section 12 on an opposite side of the coaxial cable 2. The fitting section 16 can be screwed with an external conductor of the object to be connected.

The insertion section 12 is formed so that an outer diameter thereof is increased from one side toward an opposite side thereof. The one side is a side to be inserted to between the insulation member 6 and the braided conductor 8 of the coaxial cable 2. The insertion section 12, the fitting section 16, and the flange section 14 are integrated by inserting the insertion section 12 from a side with a smaller diameter through holes of the fitting section 16 and the flange section 14 in this order and press-fitting the insertion section 12 into the hole of the flange section 14. The fitting section 16 is provided rotatably with respect to the insertion section 12 around a central axis thereof by being positioned between the flange section 14 and an open end of the insertion section 12 with the largest outer diameter of the insertion section 12.

The securing ring 20 includes an annular ring and a pair of crimping projections 22, 24 provided thereon in a protruding manner, as in the conventional connector shown in FIGS. 7A-7E. An outer diameter of the annular ring excluding the crimping projections 22, 24 is approximately the same as that of the flange section 14.

The connector body 10 and the securing ring 20 are formed of conductive metal to secure mechanical strength and electrical conductivity.

The holder 30 includes a tubular fixation section 32 and a holding section 34. The fixation section 32 is fixable around the flange section 14. The holding section 34 is provided in an extending manner from the fixation section 32 and can hold the securing ring 20 thereinside. As a whole, the holding section 34 is formed in a shape of a tube with the same diameter as the fixation section 32. The holding section 34 includes a notch formed thereon. The pair of crimping projections 22, 24 provided on the securing ring 20 in the protruding manner can be protruded outward from the notch so that the crimping projections 22, 24 can be pinched and crimped with a tool even while the securing ring 20 is held in the holding section 34.

At an open end of the holding section 34 on an opposite side of the fixation section 32, a holding projection 35 is formed to inhibit the securing ring 20 from falling off of the holding section 34 by engaging with an end portion of the securing ring 20 held inside the holding section 34.

At an open end of the fixation section 32 on an opposite side of the holding section 34, a fixing projection 33 is formed to inhibit the holder 30 from falling off of the flange section 14 by engaging with a corner edge portion of the flange section 14 on a side of the fitting section 16 when the flange section 14 is inserted inside the fixation section 32 to fix the holder 30 to the flange section 14.

The fixation section 32 and the holding section 34 of the holder 30 are integrally formed of synthetic resin (e.g., polypropylene).

When attaching the thus configured connector of the present embodiment to a tip end of the coaxial cable 2, the securing ring 20 is first attached to the connector body 10 via the holder 30 by putting the securing ring 20 inside the holding section 34 of the holder 30 and inserting the flange section 14 of the connector body 10 inside the fixation section 32 of the holder 30, as shown in FIGS. 1A and 2A.

The tip end of the coaxial cable 2 is processed in a conventional manner as shown in FIGS. 7A-7E so that the insertion section 12 of the connector body 10 is easily inserted to between the insulation member 6 and the braided conductor 8.

Then, while the securing ring 20 is fixed to the flange section 14, the connector body 10 is inserted from the tip end side of the coaxial cable 2 such that the insulation member 6 of the coaxial cable 2 is inserted into the insertion section 12 of the connector body 10.

As a result, the braided conductor 8, which has been folded back rearward from the tip end side of the coaxial cable 2, is automatically received inside the securing ring 20. Thereafter, when the crimping projections 22, 24 of the securing ring 20 are crimped with a pair of pliers or the like as in the case of the conventional connector, the connector can be smartly fixed to the tip end of the coaxial cable 2.

Thus, according to the connector of the present embodiment, the crimping operation, and the attaching operation of the connector to the coaxial cable 2, can be extremely easily carried out as compared to conventional operations.

As described hereinbefore, according to the connector of the present embodiment, the connector can be smartly and easily fixed to the tip end of the coaxial cable 2 because the security ring 20 can be positioned at the crimping position around the insertion section 12 of the connector body 10 via the holder 30.

In the present embodiment, the holder 30 is particularly formed of synthetic resin. Compared with a case where the holder 30 is formed of metal, it is more easily performed to attach the holder 30 to the flange section 14 and to put the securing ring 20 inside the holder 30.

The connector of the present embodiment can be achieved only by providing the holder 30 with the conventional coaxial cable connector shown in FIGS. 7A-7E. That is, the connector of the present embodiment can be achieved extremely easily because the conventional coaxial cable connector can be utilized as it is.

In addition, the fixation projection is formed at the open end of the holder 30 on the side of the fixation section 32, and the holding projection is formed at the open end of the holder 30 on the side of the holding section 34. Such a configuration makes it possible to firmly fix the holder 30 to the flange section 14 and inhibit the securing ring 20 held in the holding section 34 from falling off. Thus, the connector body 10 and the securing ring 20, which conventionally have been randomly stored, can be carried integrally to simplify handling of such parts.

In the above, an embodiment of the present invention has been described. However, the present invention should not be limited to the above embodiment, but can be practiced in various manners within the scope not departing from the spirit of the present invention.

(Variation 1)

For instance, in the above embodiment, the holding section 34 of the holder 30 is tubular and provided with the notch from which the crimping projections 22, 24 can be projected outward. However, as shown in FIGS. 3A and 3B, the holding section 34 may be provided with a plurality of slits 36 formed parallel to a central axis of the holding section 34.

When the holding section 34 is provided with the slits 36, it is easier to radially expand the open end of the holding section 34. Thus, workability of putting the securing ring 20 in the holding section 34 and removing the securing ring 20 from the holding section 34 can be improved.

Figure 3A:
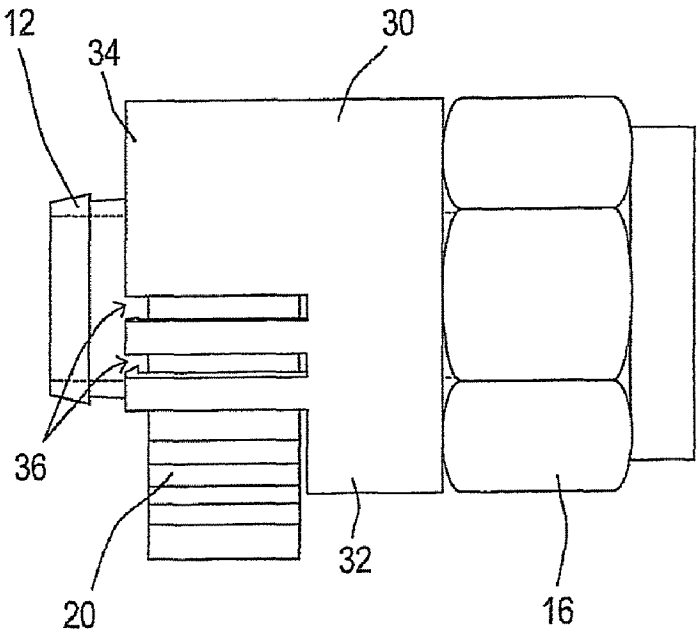
FIGS. 3A-3B are explanatory views showing a composition of a coaxial cable connector according to variation 1.
Figure 3B:
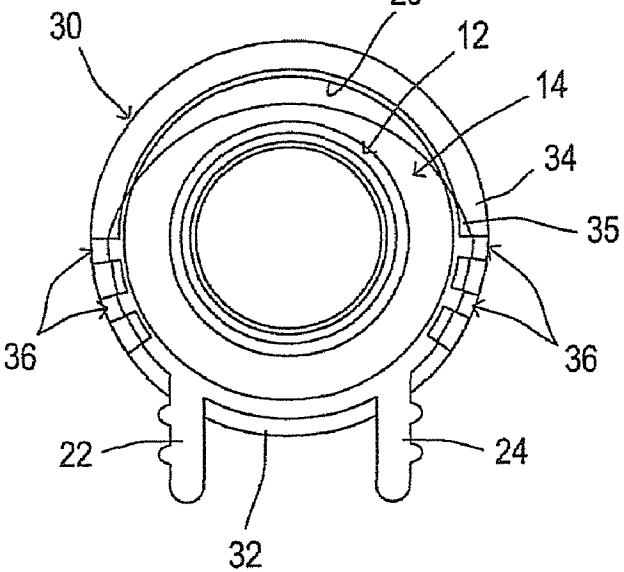

FIG. 3A is a side view of the connector, and FIG. 3B is an end view of the connector viewed from a side to be attached to the coaxial cable 2 (a left side view of the connector in FIG. 3A).

(Variation 2)

Figure 4A:
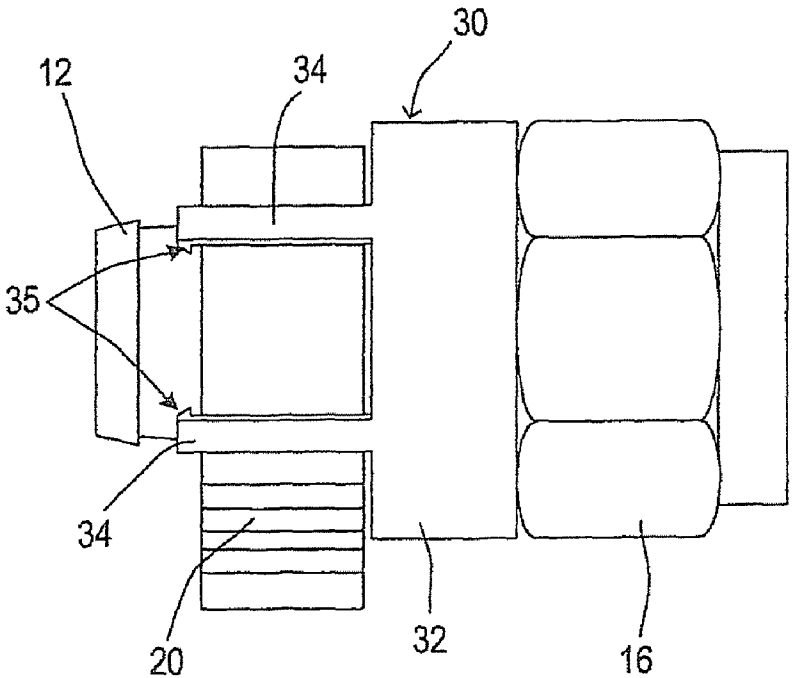
FIGS. 4A-4B are explanatory views showing a composition of a coaxial cable connector according to variation 2.
Figure 4B:
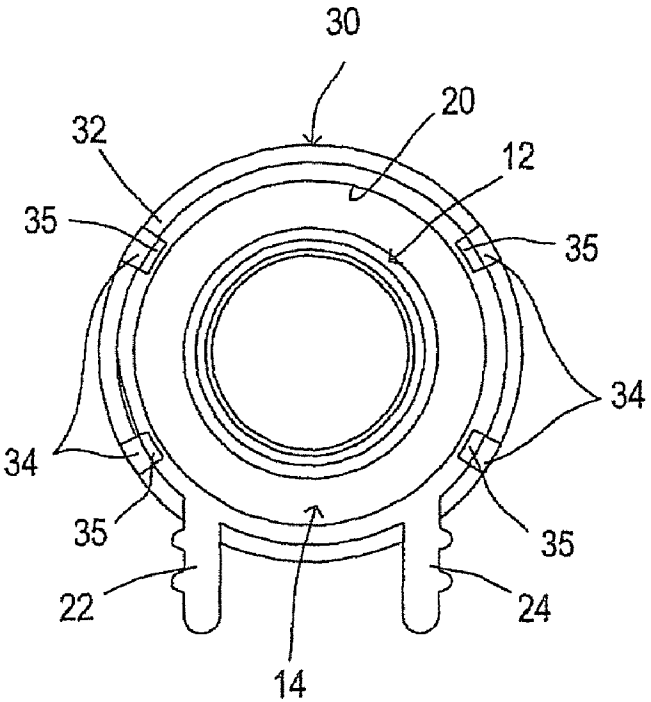

It is not always necessary for the holding section 34 of the holder 30 to be formed tubularly. As shown in FIGS. 4A and 4B, the holding section 34 may be configured by four rod-shaped members which are dispersedly arranged in a protruding manner at an open end of the fixation section 32, so that the rod-shaped members support the securing ring 20 at four points around the securing ring 20. The securing ring 20 can be held at the crimping position around the insertion section 12 even in such a configuration.

FIG. 4A is a side view of the connector, and FIG. 4B is an end view of the connector viewed from a side to be attached to the coaxial cable 2 (a left side view of the connector in FIG. 4A).

When the holding section 34 is configured by the rod-shaped members provided in the protruding manner from the open end of the fixation section 32 as above, it is necessary to arrange at least three rod-shaped members radially around a central axis of the holder 30.

(Variation 3)

Figure 5B:
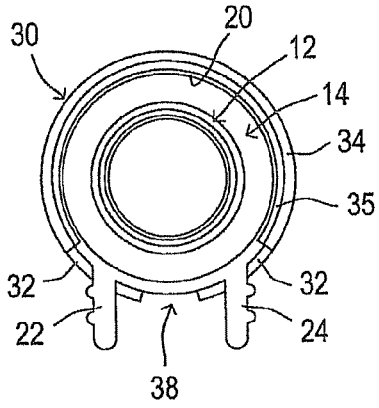
FIGS. 5A-5C are explanatory views showing a composition of a coaxial cable connector according to variation 3.
Figure 5A:
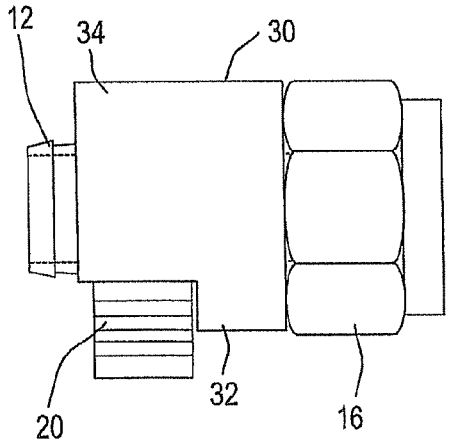
Figure 5C:
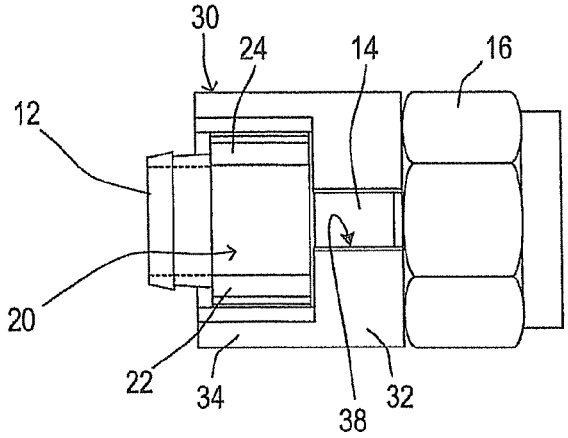

In the above embodiment, the fixation section 32 of the holder 30 is formed in a shape of a tube fittable with the flange section 14 of the connector body 10. However, as shown in FIGS. 5A-5C, the fixation section 32 may include a cut-in section (a slit 38) formed continuously from an open end on the side of the holding section 34 through an opposite open end. Thus, the fixation section 32 can be radially expanded when the holder 30 is attached to the flange section 14. The workability of attaching the holder 30 to the flange section 14 can be thereby improved.

FIG. 5A is a side view of the connector. FIG. 5B is an end view of the connector viewed from a side to be attached to the coaxial cable 2 (a left side view of the connector in FIG. 5A). And FIG. 5C is a bottom view of the connector (a lower side view of the connector in FIG. 5A).

Second Embodiment

In the above embodiment, the holder 30 is configured separately from the connector body 10, and detachably attached to the flange section 14. However, the holder 30 may be integrally assembled with the connector body 10.

The coaxial cable connector in which the holder 30 is integrally assembled with the connector body 10 will now be described as a second embodiment of the present invention.

Figure 6A:
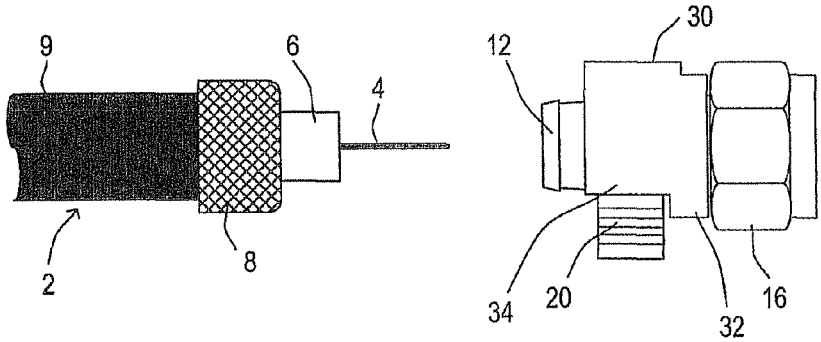
FIGS. 6A-6D are explanatory views showing a composition of a coaxial cable connector according to a second embodiment.
Figure 6B:
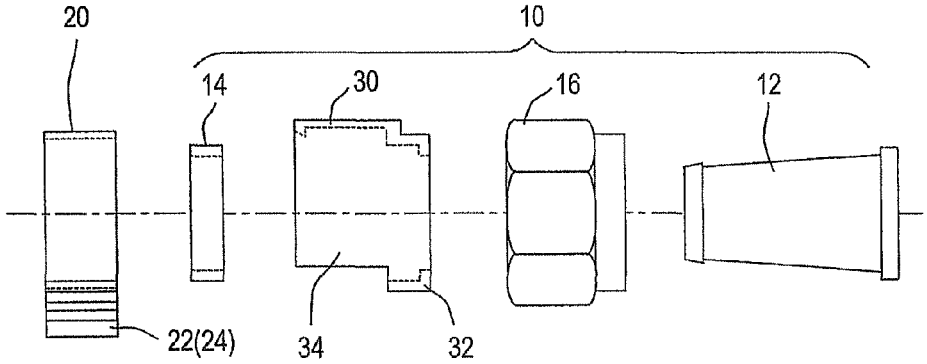
Figure 6C:
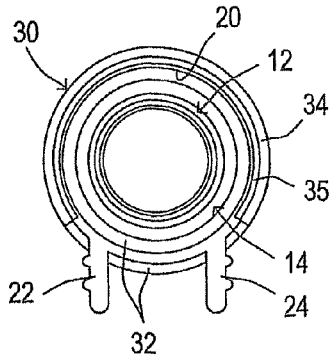
Figure 6D:
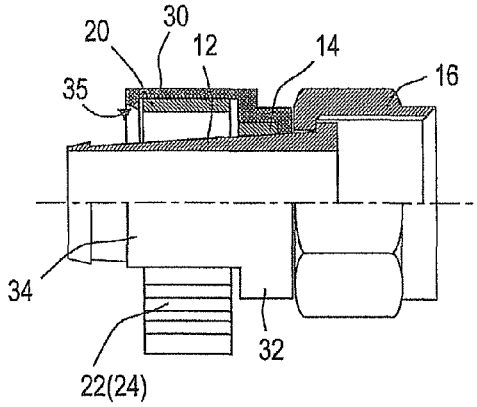
Figure 7A:
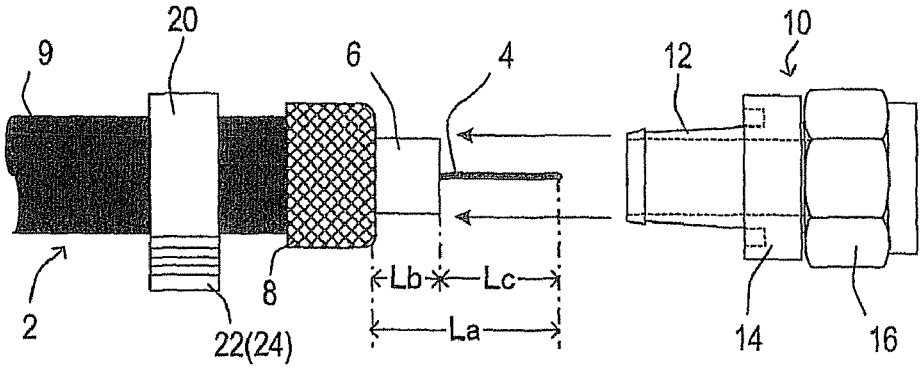
FIGS. 7A-7E are explanatory views illustrating a composition of a conventional coaxial cable connector and steps for attaching the connector to a coaxial cable.
Figure 7B:
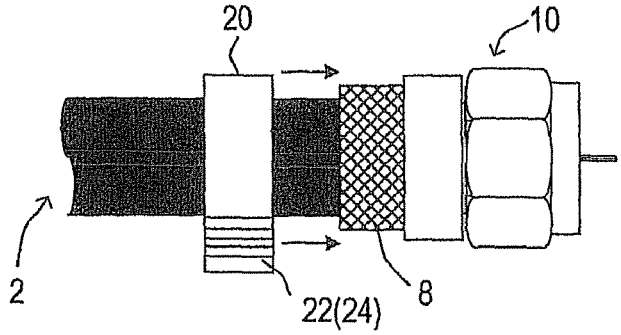
Figure 7C:
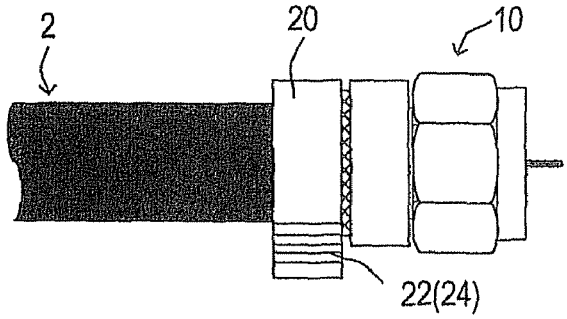
Figure 7D:
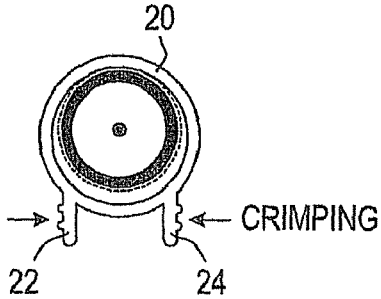
Figure 7E:
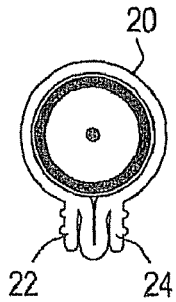

FIGS. 6A-6D are explanatory views showing a composition of a coaxial cable connector according to the second embodiment. FIG. 6A is a side view showing the connector along with the coaxial cable 2 yet to be attached, FIG. 6B is a side view showing a disassembled state of the connector, FIG. 6C is an end view of the connector viewed from the side to be attached to the coaxial cable 2 (a left side view of the connector in FIG. 6A), and FIG. 6D is a partially fractured side view showing an internal structure of the connector.

As shown in FIGS. 6A-6D, the connector of the present embodiment is different from the first embodiment in its shapes of the holder 30 and the flange section 14. The insertion section 12, the fitting section 16, and the securing ring 20 are configured in the same manner as in the first embodiment.

Accordingly, a description concerning the same points as the first embodiment is omitted here, and different points from the first embodiment will now be described.

As shown in FIGS. 6B and 6D, the flange section 14 is formed in a shape of a ring with a smaller outer diameter than that in the first embodiment (in other words, a smaller outer diameter than that of the fitting section 16). In the holder 30, the holding section 34 is formed in the same manner as in the first embodiment, while the fixation section 32 is formed in a shape of a tube with such an inner diameter as to enable the flange section 14 with the smaller diameter as above to be fitted inside the fixation section 32. The fixation section 32 includes a wall section formed at an open end thereof on an opposite side of the holding section 34. The wall section includes an opening formed thereon, through which the insertion section 12 is insertable.

The connector body 10 is formed by inserting the inserting section 12 from a side with a smaller diameter of the inserting section 12 through holes of the fitting section 16, the holder 30, and the flange section 14 in this order and press-fitting the insertion section 12 into the hole of the flange section 14. That is, the insertion section 12, the fitting section 16, the holder 30, and the flange section 14 are integrated to form the connector body 10 in the present embodiment. The holder 30 is formed of synthetic resin, while the other parts are formed of metal having electrical conductivity.

According to the thus configured connector of the present embodiment, it is possible to obtain similar effects to those in the first embodiment, and to more firmly position the securing ring 20 at a crimping position because the holder 30 is integrally assembled with the connector body 10.

In the present embodiment, it is preferable to make it easier to attach/detach the securing ring 20 to/from the holding section 34 of the holder 30 than in the first embodiment because the holder 30 is assembled with the connector body 10. Therefore, the slits 36 may be formed on the holding section 34, or the holding section 34 may be configured by three or more rod-shaped members as in the above-described variations 1 and 2.

In each of the above-described embodiments and variations, the fitting section 16 is formed in the shape of the hexagonal nut which can be screwed with the object to be connected such as the F-type relay, the F-type antenna terminal and so on. However, it is not always necessary to form the fitting section 16 into a shape of a nut having a screw thread thereinside. For example, an annularly deformed leaf spring may be provided on an inner wall surface of the fitting section 16 so that the fitting section 16 is connected to the object to be connected with a biasing force of the leaf spring.

Further, it is not always necessary for a periphery of the fitting section 16 to be formed hexagonally. The fitting section 16 may be cylindrically formed with a non-slip knurled surface provided on an outer peripheral surface thereof. Alternatively, the fitting section 16 may be covered with a non-slip annular member formed of elastic synthetic resin, rubber, or the like instead of being knurled.

It is explained above that the tip end of the coaxial cable 2 is processed in the conventional manner as shown in FIGS. 7A-7E when the connector body 10 is attached to the coaxial cable 2. The purpose of processing the tip end of the braided conductor 8 of the coaxial cable 2 is to facilitate insertion of the insertion section 12 of the connector body 10 to between the insulation member 6 and the braided conductor 8 of the coaxial cable 2. Therefore, such a processing is not always necessary. It will be understood that the connector body 10 can be attached to the coaxial cable 2 without the processing of the tip end of the braided conductor 8 of the coaxial cable 2.

The invention claimed is:

1. A coaxial cable connector comprising a connector body including: a tubular insertion section that is insertable to between an insulation member around a core wire of a coaxial cable and a braided conductor around the insulation member; a flange section that is provided around the insertion section and against which both the braided conductor of the coaxial cable and a cover member around the braided conductor abut to position the insertion section with respect to the coaxial cable when the insertion section is inserted in the coaxial cable; and an annular fitting section that is provided at the insertion section on an opposite side of the coaxial cable, and into which an object to be connected can be fittingly inserted, and a securing ring that includes a pair of crimping projections provided on an outer periphery thereof and is used to crimp and fix the coaxial cable to the insertion section from a periphery of the coaxial cable after the insertion section of the connector body is inserted in the coaxial cable, wherein a holder is provided which includes a tubular fixation section that is fixable around the flange section; and a holding section that is provided in an extending manner from the fixation section to hold the securing ring from a periphery thereof while the crimping projections are protruded outward, and the holder positions the securing ring at a position where the coaxial cable is crimped.

2. The coaxial cable connector according to claim 1, wherein the holder is configured separately from the connector body and the holder includes a fixing projection formed at an open end of the fixation section on an opposite side of the holding section, the fixing projection inhibiting the holder from falling off of the flange section by engaging with a corner edge portion of the flange section on a side of the fitting section when the flange section is inserted in the fixation section.

3. The coaxial cable connector according to claim 1, wherein the holder includes a wall section that has an opening, through which the insertion section is insertable, the wall section being formed at the open end of the fixation section on the opposite side of the holding section, and further wherein the holder is integrated with the connector body by positioning the wall section between the flange section and the fitting section around the insertion section.

4. The coaxial cable connector according to claim 1, wherein the holding section in the holder is configured by a tubular member on which a notch is formed, and the pair of crimping projections is protruded outward from the notch so that the pair of the crimping projections can be crimped outside the holder.

5. The coaxial cable connector according to claim 4, wherein the holding section includes a plurality of slits formed parallel to a central axis of the holding section.

6. The coaxial cable connector according to claim 1, wherein the holding section in the holder is configured by three or more rod-shaped members which are dispersedly arranged around the securing ring.

7. The coaxial cable connector according to claim 1, wherein the holder includes a holding projection formed at an open end of the holding section on an opposite side of the fixation section to inhibit the securing ring from falling off by engaging with an end portion of the securing ring held inside the holding section.

8. The coaxial cable connector according to claim 1, wherein the fixation section in the holder includes a slit formed continuously from the open end on the side of the holding section through an opposite open end, so that the fixation section can be radially deformed when attached to the flange section.

9. The coaxial cable connector according to claim 1, wherein the holder is formed of synthetic resin.

* * * * *